US009617718B2

(12) United States Patent
Tanaka et al.

(10) Patent No.: US 9,617,718 B2
(45) Date of Patent: Apr. 11, 2017

(54) DIGGING TOOTH MOUNTING ASSEMBLY AND DIGGING TOOTH

(71) Applicant: KOMATSU LTD., Tokyo (JP)

(72) Inventors: Kenichi Tanaka, Jiangsu (CN); Tatsuo Aira, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/379,578

(22) PCT Filed: Dec. 17, 2013

(86) PCT No.: PCT/JP2013/083691
§ 371 (c)(1),
(2) Date: Aug. 19, 2014

(87) PCT Pub. No.: WO2014/098057
PCT Pub. Date: Jun. 26, 2014

(65) Prior Publication Data

US 2015/0013198 A1 Jan. 15, 2015

(30) Foreign Application Priority Data

Dec. 18, 2012 (JP) ..... 2012-275320

(51) Int. Cl.
*E02F 9/28* (2006.01)

(52) U.S. Cl.
CPC ..... *E02F 9/2808* (2013.01); *E02F 9/2825* (2013.01); *E02F 9/2833* (2013.01); *E02F 9/2858* (2013.01)

(58) Field of Classification Search
CPC ..... E02F 9/28–9/2858
See application file for complete search history.

(56) References Cited

U.S. PATENT DOCUMENTS 1,808,311 A * 6/1931 Madonna ..... E02F 9/2825 37/456
3,012,346 A * 12/1961 Larsen ..... E02F 9/2841 37/457

(Continued)

FOREIGN PATENT DOCUMENTS

CN 85 2 05861 U 12/1986
JP 60-76149 U 5/1985

(Continued)

OTHER PUBLICATIONS

The International Search Report for the corresponding international application No. PCT/JP2013/083691, issued on Mar. 4, 2014.

(Continued)

*Primary Examiner* — Matthew D Troutman
(74) *Attorney, Agent, or Firm* — Global IP Counselors, LLP

(57) ABSTRACT

A digging tooth mounting assembly has an adapter, a digging tooth and a retainer assembly. The adapter includes a front surface facing the digging tooth, a recess formed on the front surface, an inserted part projecting from the front surface, and a insertion through hole formed in the inserted part for receiving the retainer assembly. The digging tooth includes a rear surface facing the front surface of the adapter, a projecting part formed on the rear surface for insertion into the recess, an insertion hole formed on the rear surface for receiving the inserted part, and a pair of shaft bores for receiving the retainer assembly. An outer peripheral surface of the projecting part is spaced apart from an inner bottom surface and an inner side surface of the recess.

9 Claims, 10 Drawing Sheets

(56) References Cited

U.S. PATENT DOCUMENTS

| | | | | | |
|---|---|---|---|---|---|
| 3,191,323 | A * | 6/1965 | Compagnoni | E02F 9/2833 | 172/762 |
| 3,197,894 | A * | 8/1965 | Ratkowski | E02F 9/2841 | 172/762 |
| 3,277,592 | A * | 10/1966 | Launder | E02F 9/2841 | 37/457 |
| 4,577,423 | A | 3/1986 | Hahn | | |
| 5,068,986 | A * | 12/1991 | Jones | E02F 9/2841 | 37/446 |
| 5,144,762 | A * | 9/1992 | Robinson | E02F 9/2816 | 37/453 |
| 5,423,138 | A | 6/1995 | Livesay et al. | | |
| 5,987,787 | A * | 11/1999 | Mack | E02F 9/2825 | 172/713 |
| 5,992,063 | A | 11/1999 | Mack | | |
| 6,477,796 | B1 | 11/2002 | Cornelius | | |
| 6,491,469 | B1 * | 12/2002 | Pasqualini | E02F 9/2833 | 37/455 |
| 6,959,506 | B2 * | 11/2005 | Adamic | E02F 9/2825 | 172/753 |
| 7,032,334 | B2 * | 4/2006 | Pippins | E02F 9/2841 | 37/455 |
| 7,036,249 | B2 * | 5/2006 | Mautino | E02F 9/2841 | 37/455 |
| 7,788,830 | B2 * | 9/2010 | Woerman | E02F 9/2825 | 172/772 |
| 8,434,248 | B2 * | 5/2013 | Woerman | E02F 9/2825 | 37/456 |
| 8,495,826 | B2 * | 7/2013 | Itou | E02F 9/2833 | 37/456 |
| 9,085,876 | B2 * | 7/2015 | Swinscoe | E02F 9/2833 | |
| 9,267,270 | B2 * | 2/2016 | Tanaka | E02F 9/2825 | |
| 2001/0052196 | A1 * | 12/2001 | Pippins | E02F 9/2833 | 37/456 |
| 2002/0000053 | A1 * | 1/2002 | Adamic | E02F 9/2825 | 37/456 |
| 2004/0216336 | A1 | 11/2004 | Briscoe | | |
| 2004/0221491 | A1 | 11/2004 | Briscoe | | |
| 2004/0244236 | A1 * | 12/2004 | Mautino | E02F 9/2841 | 37/456 |
| 2006/0127239 | A1 * | 6/2006 | Adamic | E02F 9/2825 | 417/360 |
| 2007/0137072 | A1 | 6/2007 | Briscoe | | |
| 2008/0201996 | A1 * | 8/2008 | Pasqualini | E02F 9/2825 | 37/456 |
| 2011/0000109 | A1 | 1/2011 | Woerman et al. | | |
| 2011/0023336 | A1 | 2/2011 | Briscoe | | |
| 2011/0058894 | A1 * | 3/2011 | Heaphy | E02F 9/2833 | 403/157 |
| 2011/0314709 | A1 * | 12/2011 | Swinscoe | E02F 9/2833 | 37/455 |
| 2013/0097894 | A1 * | 4/2013 | Pippins | E02F 9/2825 | 37/455 |

FOREIGN PATENT DOCUMENTS

| | | | |
|---|---|---|---|
| JP | 2011-99322 | A | 5/2011 |
| JP | 2011-246974 | A | 12/2011 |

OTHER PUBLICATIONS

The Office Action for the corresponding Japanese application No. 2014-525233, issued on Jul. 29, 2014.

The Office Action for the corresponding Chinese application No. 201380009172.9, issued on Sep. 1, 2015.

* cited by examiner

DIGGING TOOTH MOUNTING ASSEMBLY AND DIGGING TOOTH

CROSS-REFERENCE TO RELATED APPLICATIONS

This application is a U.S. National stage application of International Application No. PCT/JP2013/083691, filed on Dec. 17, 2013. This U.S. National stage application claims priority under 35 U.S.C. §119(a) to Japanese Patent Application No. 2012-275320, filed in Japan on Dec. 18, 2012, the entire contents of which are hereby incorporated herein by reference.

BACKGROUND

Field of the Invention

The present invention relates to a digging tooth mounting assembly and a digging tooth used on a work machine.

Background Information

Work vehicles, such as a hydraulic excavator and the like, are generally provided with an excavating tool, such as a bucket or ripper. An adapter with a projection segment is secured, for instance, at the tip end of the bucket. A tooth, which is a cutting edge, includes an insertion hole that receives the projection segment of the adapter so that the digging tooth can be installed on the adapter, or in other words, mounted to the bucket. (For example, refer to Japanese Laid-Open Patent Application 2011-246974). The inner and outer surfaces of the digging tooth will wear with use and are generally replaced as appropriate.

SUMMARY

As above described, the inner surface of the digging tooth wears. External forces acting on the digging tooth lead to (i) a large amount of stress being generated between the adapter and the digging tooth, (ii) the digging tooth pivoting slightly relative to the adapter, and (iii) dirt and the like entering between the contact surfaces of the adapter and the digging tooth, resulting in wear of the surfaces in contact between the adapter and the digging tooth. The tooth tends to pivot even more when the contact surfaces of the adapter and tooth wear. Once the amount of pivoting increases, the contact surface wears even further, creating a detrimental cycle that precipitates wear. Consequently, this shortens the lifespan of the components.

The present invention aims to address above-mentioned problems and provides a digging tooth mounting assembly and digging tooth capable of controlling pivoting and suppressing wear.

A digging tooth mounting assembly according to the first exemplary embodiment of the present invention is provided with an adapter, a digging tooth that is mounted to the adapter, and a retainer assembly that holds the digging tooth onto the adapter. The adapter includes a front surface facing the digging tooth, a recess formed on the front surface, an inserted part projecting from the front surface, and an insertion through hole formed in the inserted part for receiving the retainer assembly. The digging tooth includes a rear surface facing the front surface of the adapter, a projecting part formed on the rear surface for insertion into the recess, an insertion hole formed on the rear surface for receiving the inserted part, and a pair of shaft bores for receiving the retainer assembly. The rear surface has a rectangular outer edge constituted by a pair of long sides and a pair of short sides. The pair of shaft bores is formed along the pair of long sides. An outer peripheral surface of the projecting part faces an inner bottom surface and an inner side surface of the recess. The outer peripheral surface of the projecting part is spaced apart from the inner bottom surface and the inner side surface of the recess.

In the digging tooth mounting assembly according to the first exemplary embodiment of the present invention, the digging tooth pivots with the site held by the retainer assembly as the fulcrum. When there is little pivoting of the digging tooth relative to the adapter about the fulcrum, the outer peripheral surface constituted by the bottom surface and the side surface of the projecting part and the inner surface of the recess facing the outer peripheral surface do not come in contact. Whereas, when the amount of pivot of the digging tooth relative to the adapter increases as the wear progresses, the outer peripheral surface of the projecting part and the inner surface of the recess come into contact to suppress increased pivoting and wear.

The digging tooth mounting assembly according to a second exemplary embodiment of the present invention incorporates the features of the first exemplary embodiment where the closer to the tip end part of the projecting part the larger the gap between the inner bottom surface of the recess and the outer peripheral surface of the projecting part.

In the digging tooth mounting assembly according to the second exemplary embodiment of the present invention, the portion of the digging tooth in contact with the adapter moves gradually from the tip to the base of the projecting part in accordance with the progression of wear of the portion of the digging tooth in contact with the adapter.

The digging tooth mounting assembly according to a third exemplary embodiment incorporates the features of the first and second exemplary embodiments where the outer edge of the rear surface of the digging tooth is a rectangle having long sides and short sides. The projecting part is formed on the long side of the rear surface.

In the digging tooth mounting assembly according to the third exemplary embodiment of the present invention, the projecting part on the long side of the rear surface of the tooth stops the tooth from pivoting relative to the adapter along the long side on the rear surface of the tooth and thus effectively suppresses an increase in the pivoting length.

The digging tooth mounting assembly according to a fourth exemplary embodiment of the present invention incorporates features of the first through third exemplary embodiments wherein the projecting part is spaced apart from the pair of shaft bores.

Compared to when the shaft bores are formed in the projecting part, at the point where the projecting part pivoting in relation to the recess facilitates wear on both parts, the contact between the outer peripheral surface of the projecting part and the inner surface of the recess effectively prevent pivoting and the progression of wear in the digging tooth mounting assembly according to the fourth exemplary embodiment of the present invention.

The digging tooth according to a fifth exemplary embodiment is mounted to an adapter by a retainer assembly. The digging tooth is provided with a digging tooth body, a projecting part, an insertion hole, and a pair of shaft bores that receive the retainer assembly. The digging tooth body includes a rear surface that has a rectangular outer edge constituted by a pair of long sides and a pair of short sides. The projecting part is formed on the long side of the rear surface of the digging tooth body. The insertion hole is formed on the rear surface for receiving the adapter. The pair of shaft bores is formed on both sides of the insertion hole for receiving the retainer assembly. The projecting part has a tapered cross-section. The pair of shaft bores is formed along the long side.

In the digging tooth according to the fifth exemplary embodiment of the present invention, when mounting the excavating tool, any wear or play at the contact surface between the tooth and the adapter is largely prevented because the inside of the insertion through holes as well as the projecting part on the rear surface of the tooth are in contact with the adapter. Additionally, the projecting part is along the long side of the rear surface and therefore effectively prevents the digging tooth from pivoting in relation to the adapter.

The digging tooth according to a sixth exemplary embodiment of the present invention incorporates features of the fifth exemplary embodiment wherein the projecting part is spaced apart from the pair of shaft bores.

Compared to when the shaft bores are formed in the projecting part, at the point where the projecting part pivoting in relation to the recess facilitates wear on both parts, the contact between the outer peripheral surface of the projecting part and the inner surface of the recess effectively prevent pivoting and the progression of wear in the digging teeth mount according to the sixth exemplary embodiment of the present invention.

The digging tooth according to the seventh exemplary embodiment of the present invention incorporates the features of the fifth and sixth exemplary embodiments wherein the projecting part is formed at a center of the long side on the rear surface of the tooth body.

The projecting part of the digging tooth according to the seventh exemplary embodiment of the present invention is at the center widthwise of the digging tooth and therefore pivoting of the digging tooth can be prevented without being influenced by the difference in orientation of pivoting along the width direction.

The digging tooth according to the eighth exemplary embodiment incorporates features of the fifth through seventh exemplary embodiments, wherein a hole part is formed in the bottom of the insertion hole. The hole part is narrower than the bottom of the insertion hole.

In the digging tooth according to the eighth exemplary embodiment of the present invention, dirt and the like entering between the contact surfaces of the digging tooth and the adapter travel into the recess, thus suppressing wear.

The present invention provides a digging tooth mounting assembly and digging tooth whereby it is possible to control pivoting and suppress wear.

DETAILED DESCRIPTION OF EXEMPLARY EMBODIMENTS

Exemplary embodiments of the present invention will be described with reference to the drawings. In the following exemplary embodiments, an excavator bucket 100 used on a work machine, such as a hydraulic excavator and the like, will be described as one example of an excavating tool.

Overall Configuration of the Bucket 100

Figure 1:
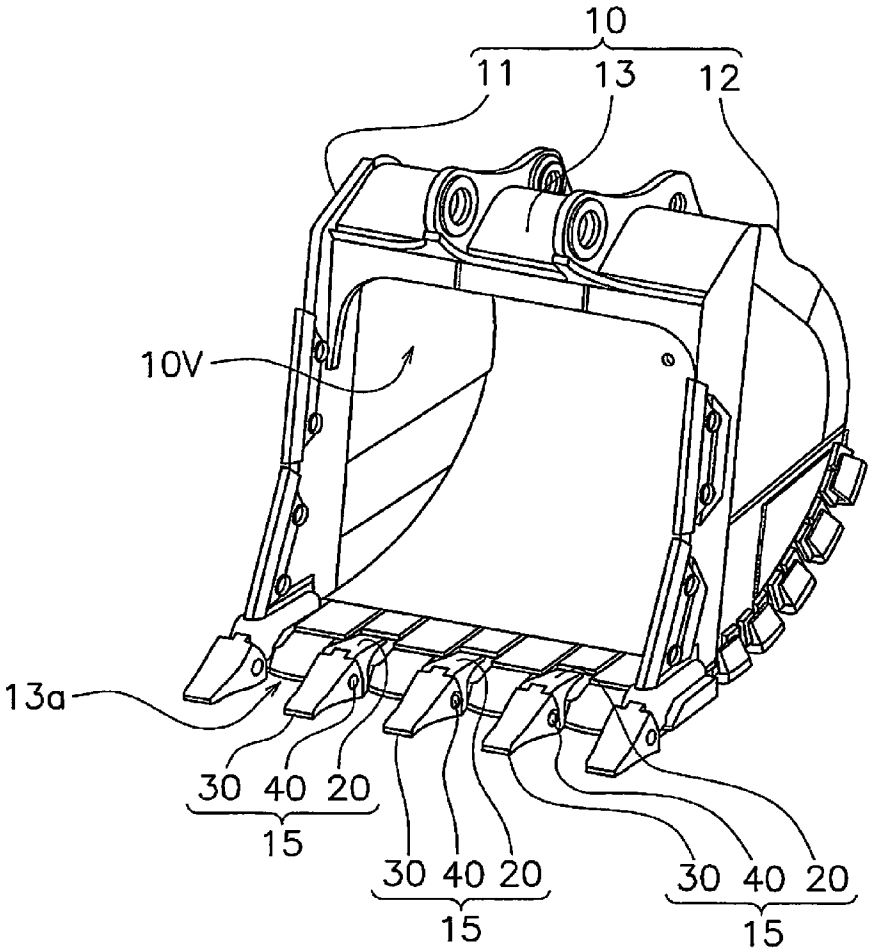
FIG. 1 is a front perspective view of a bucket.
Figure 2:
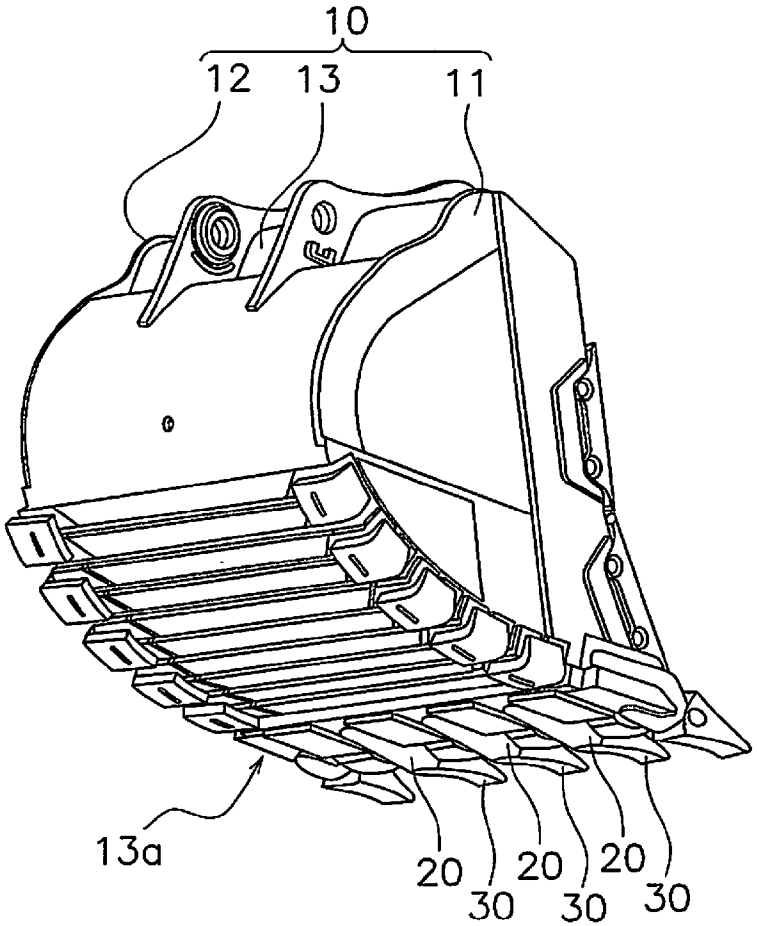
FIG. 2 is a rear perspective view of the bucket.

FIGS. 1 and 2 are perspective views of the bucket 100. As illustrated in FIGS. 1 and 2, the bucket 100 is provided with a bucket body 10, and a plurality of digging tooth mounting assemblies 15.

The bucket body 10 includes a first sidewall 11, a second sidewall, and a wrapper 13. The first sidewall 11 and the second sidewall 12 face each other. The first sidewall 11 and the second sidewall 12 are each flat sheets, and in side view, are each shaped as a flat sheet surrounded by a substantially circular arc and a bow string. The wrapper 13 is a curved sheet arranged along the substantially circular arc of the first sidewall 11 and the second sidewall 12. The wrapper 13, the first sidewall 11, and the second sidewall 12 are secured together by welding. The wrapper 13 includes a lower edge portion 13*a* (that is, the tip end portion of the bucket). The lower edge portion 13*a* is usually called a lip. The first sidewall 11, the second sidewall 12, and the wrapper 13 form a storage space 10V for storing dirt.

Each of the plurality of digging tooth mounting assemblies 15 (abbreviated to "tooth mounts" below) is constituted by an adapter 20, a digging tooth 30 (abbreviated to "tooth" below), and a retainer assembly 40.

The plurality of adapters 20 is secured on the bucket body 10 to the lower edge portion 13*a* of the wrapper 13 at prescribed intervals. The adapters 20 may be welded to the lower edge portion 13*a*. An adaptor 20 worn after a long period of use may be removed from the lower edge portion 13*a* and exchanged for a new adapter 20. In the present exemplary embodiment, the side of the adapter 20 secured to the wrapper 13 is considered the base end of the adapter 20, and the tip end of the adapter 20 is on the opposite side of the base end.

A tooth 30 is mounted at the tip end of the adapter 20. The tooth 30 has a claw-like appearance, and is formed tapering towards the tip. During excavation the outermost tip of the tooth 30 functions as a cutting edge. A tooth 30 that is worn after a long period of use may be removed from the adapter 20 and exchanged for new tooth 30. In the present exemplary embodiment the side of the tooth 30 acting as the cutting edge is considered the tip end, while the base end of the tooth 30 is the side mounted to the adapter 20.

The retainer assembly 40 is used for mounting the tooth 30 to the adapter 20. The retainer assembly 40 is stored inside the adapter 20 and the tooth 30. Disassembling the retainer assembly 40 thereby removes the worn tooth 30 from the adapter 20.

Configuration of the Tooth Mount 15

Figure 3:
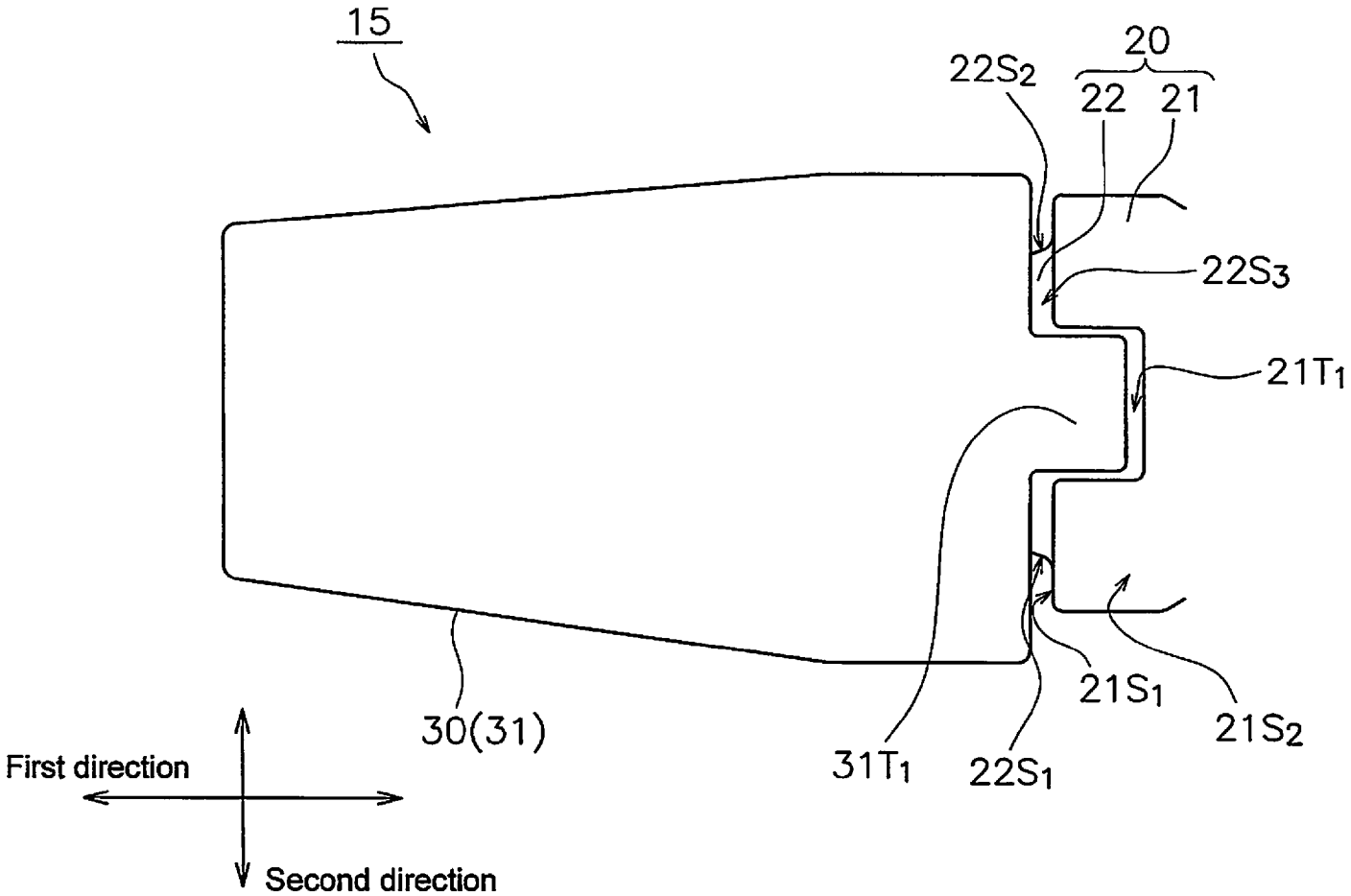
FIG. 3 is a top view of the digging tooth mounting assembly.
Figure 4:
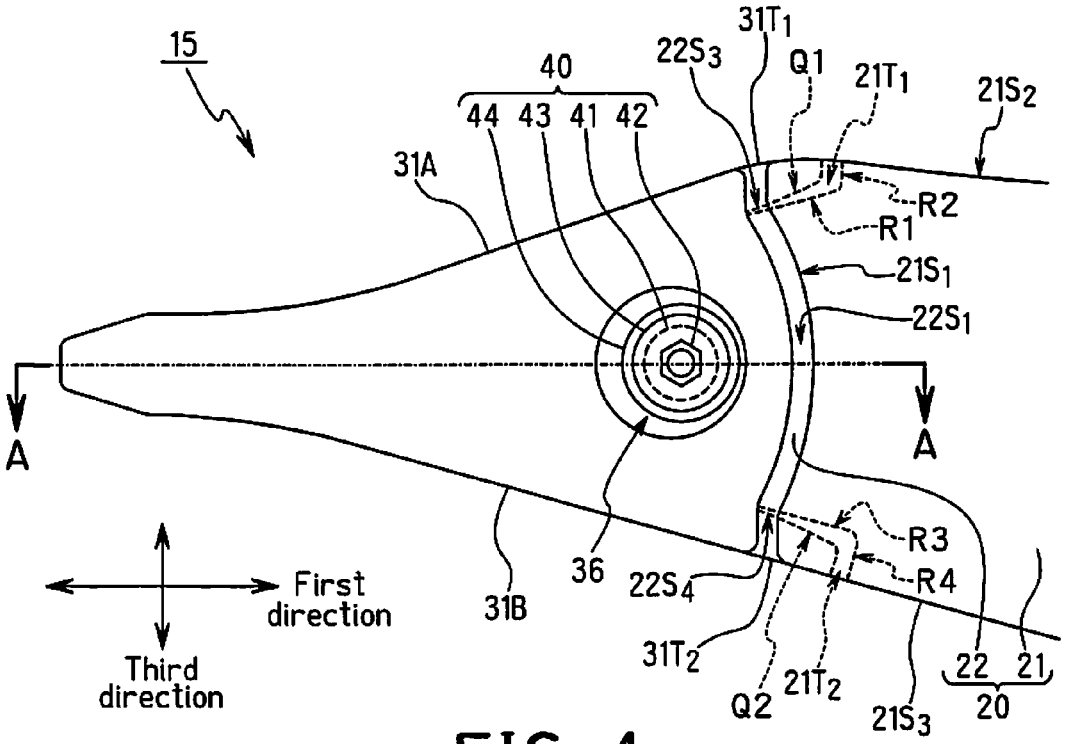
FIG. 4 is a side view of the digging tooth mounting assembly.
Figure 5:
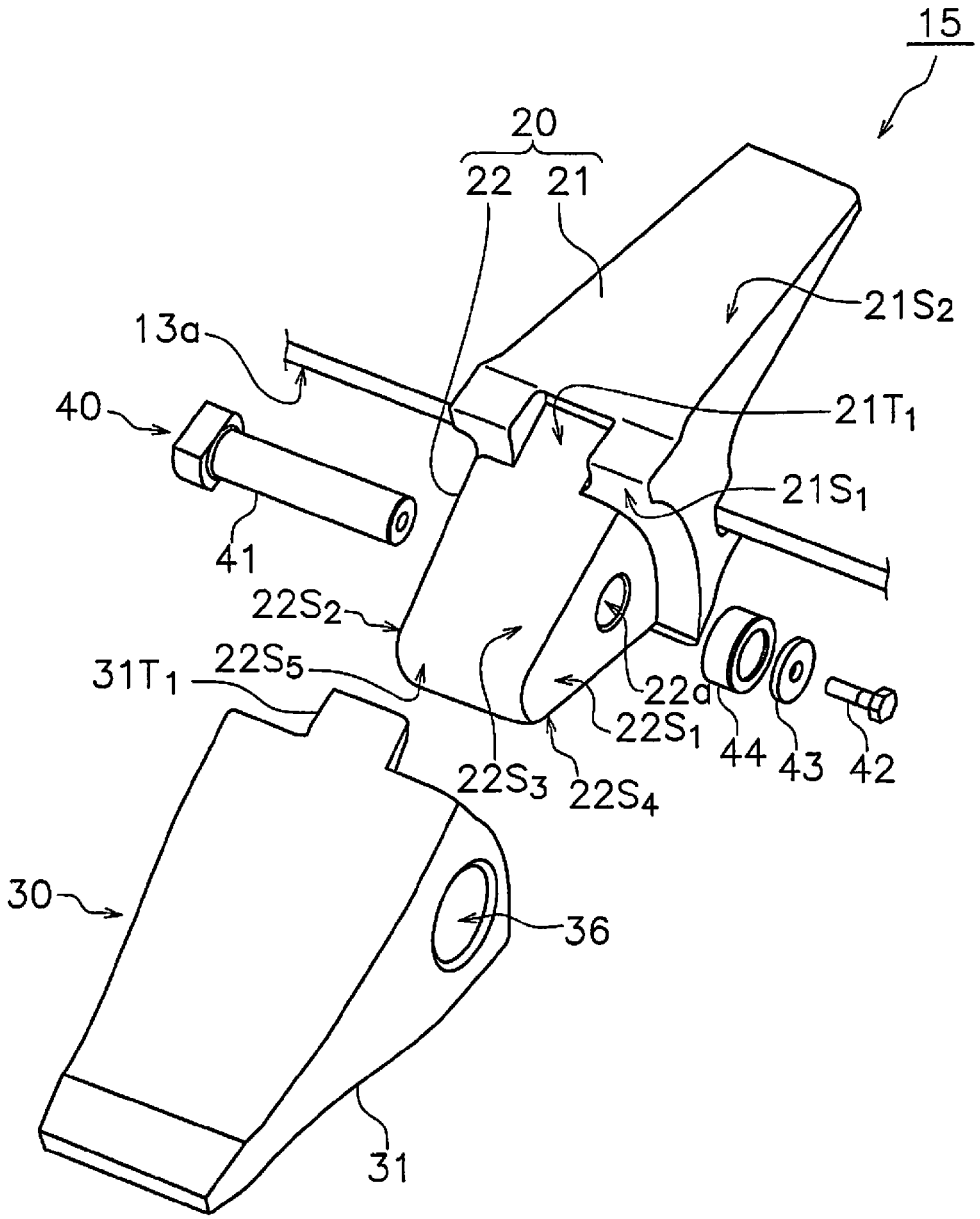
FIG. 5 is an exploded perspective view of the digging tooth mounting assembly.
Figure 6:
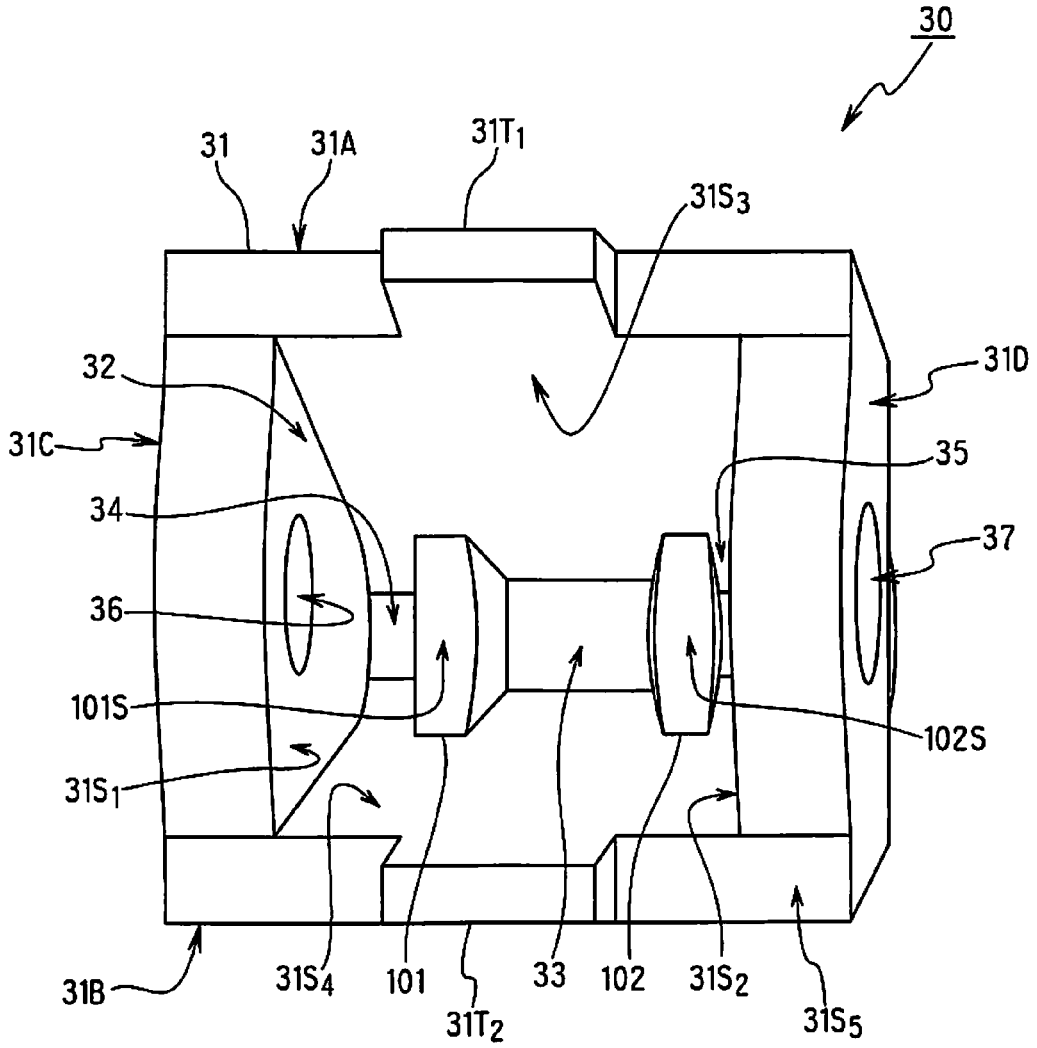
FIG. 6 is a perspective view of the digging tooth.

FIG. 3 is a top view of the tooth mount 15. FIG. 4 is a side view of the tooth mount 15. FIG. 5 is an exploded perspective view of the tooth mount 15. FIG. 6 is a perspective view of the tooth 30. In the following description, as illustrated in FIGS. 3 and 4, the direction in which the tooth body 31 extends (that is, the direction connecting the base end and the tip end of the tooth 30) is called a "first direction", the direction in which the tooth body 31 extends flatly is called a "second direction", and the direction orthogonal to the first direction and the second direction is called a "third direction". The second direction of the tooth body 31 is the width direction of the digging tooth 30.

As illustrated in FIG. 5, the adapter 20 includes a fixed part 21, and an inserted part 22. The fixed part 21 is formed by forking the base end of the adapter 20. The fixed portion 21 sandwiches the lower edge portion 13*a* of the bucket body 10. The fixed portion 21 may be secured to the lower edge portion 13*a* via welding, for example.

As illustrated in FIGS. 3 through 5, the fixed part 21 includes a front surface 21$S_1$, an upper surface 21$S_2$, a lower surface 21$S_3$, a first recess 21$T_1$, and a second recess 21$T_2$. The front surface 21$S_1$ faces the tooth 30 when the tooth 30 is mounted to the adapter 20. The upper surface 21$S_2$ extends from the front surface 21$S_1$. The lower surface 21$S_3$ extends from the front surface 21$S_1$ and is provided opposite the upper surface 21$S_2$.

The first recess 21$T_1$ is formed in the front surface 21$S_1$ and the upper surface 21$S_2$. The first recess 21$T_1$ extends from the front surface 21$S_1$ and the upper surface 21$S_2$, and is open. A later-described first projecting part 31$T_1$ of the tooth 30 is inserted into the first recess 21$T_1$.

The second recess 21$T_2$ is formed in the front surface 21$S_1$ and the lower surface 21$S_3$. The second recess 21$T_2$ extends from the front surface 21$S_1$ and the lower surface 21$S_3$, and is open. A later-described second projecting part 31$T_2$ in the tooth 30 is inserted into the second recess 21$T_2$.

The first projecting part 31$T_1$ is inserted into the first recess 21$T_1$, and the second projecting part 31$T_2$ is inserted into the second recess 21$T_2$ to thereby prevent the tooth 30 from pivoting in the second direction. However, it is still possible to mount a conventional tooth that is not provided with a first projecting part 31$T_1$ and a second projecting part 31$T_2$ to this kind of fixed part 21.

The inserted part 22 protrudes from the front surface 21$S_1$ of the fixed part 21. The inserted part 22 is inserted into the later-described insertion hole 32 (refer to FIG. 6) of the tooth body 31. As illustrated in FIGS. 3 through 5, the inserted part 22 includes a first side surface 22$S_1$, a second side surface 22$S_2$, an upper surface 22$S_3$, a lower surface 22$S_4$, a tip end surface 22$S_5$, and an insertion through hole 22*a*. The first side surface 22$S_1$ and the second side surface 22$S_2$ are provided on mutually opposite sides. The upper surface 22$S_3$ and the lower surface 22$S_4$ are provided on mutually opposite sides. The tip end surface 22$S_5$ extends from the first side surface 22$S_1$, the second side surface 22$S_2$, the upper surface 22$S_3$, and the lower surface 22$S_4$. In the present exemplary embodiment, the tip end surface 22$S_5$ is given a smooth curve spanning from the upper surface 22$S_3$ to the lower surface 22$S_4$; however, there is no need to be limited to this form. The tip end surface 22$S_5$ may be, for example, a flat surface. The insertion through hole 22*a* passes through the inserted part 22 from the first side surface 22$S_1$ through to the second side surface 22$S_2$. A pin 41 for the retainer assembly 40 (later described) is inserted in the insertion through hole 22*a*.

FIG. 6 is a diagram of the tooth 30 when viewed from the base end. As illustrated in FIG. 6, the tooth 30 includes a tooth body 31, an insertion hole 32, a sign pocket 33 (a hole part), a first extension hole 34, a second extension hole 35, a first shaft bore 36, a second shaft bore 37, a first projecting part 31$T_1$, and a second projecting part 31$T_2$.

As illustrated in FIGS. 3 and 4, the tooth body 31 tapers in the second direction and in the third direction to have a wedge-like shape. The wedge shape is defined by an upper wall 31A and a lower wall 31B. A pair of side walls 31C and 31D are provided between the upper wall 31A and the lower wall 31B. The tooth body 31 is formed with a cuplike shape, as illustrated in FIG. 6.

As illustrated in FIG. 6, the tooth body 31 includes a first inner side surface 31$S_1$, a second inner side surface 31$S_2$, an upper inner surface 31$S_3$, a lower inner surface 31$S_4$, a rear surface 31$S_5$ (an example of an outer surface), a first projecting part 31$T_1$, a second projecting part 31$T_2$, a first support 101, and a second support 102.

The first inner side surface 31$S_1$ faces the first side surface 22$S_1$ of the inserted part 22. A small gap may be provided between the first inner side surface 31$S_1$ and the first side surface 22$S_1$. The second inner side surface 31$S_2$ faces the second side surface 22$S_2$. A small gap may be provided between the second inner side surface 31$S_2$ and the second side surface 22$S_2$. The upper inner surface 31$S_3$ is in contact with the upper surface 22$S_3$ of the inserted part 22. The lower inner surface 31$S_4$ is in contact with the lower surface 22$S_4$ of the inserted part 22.

The rear surface 31$S_5$ is the base end surface of the tooth body 31. The rear surface includes end surfaces shaped in a rectangle having two long sides and two short sides for the outer edge; the insertion hole 32 is formed on the inner side of the end surface. The long sides are formed by end surfaces of the upper and lower walls 31A and 31B, respectively, and the short sides are formed by end surfaces of the side walls 31C and 31D. When inserted into the adapter 20, the direction along the long side of the rear surface of the tooth 30 (the second direction) is substantially parallel to the lower edge part 13*a* of the bucket body 10, while the direction along the short side (the third direction) intersects with the lower edge part 13*a*. The rear surface 31$S_5$ faces the front surface 21$S_1$ of the fixed part 21. A gap may be provided between the rear surface 31$S_5$ and the front surface 21$S_1$ A pair of the first projecting part 31$T_1$ and the second projecting part 31$T_2$ is respectively formed in the long sides of the rear surface 31$S_5$ of the digging tooth body 31.

The first projecting part 31$T_1$ is a rectangular portion formed protruding from the end surface on the long side of the outer edge of the rear surface 315S. The projecting part 31$T_1$ is substantially the same thickness as the rear surface 31$S_5$. The projecting part 31$T_1$ is located at the center of the end surface of the long side of the outer edge of the rear surface 31$S_5$. The projecting part 31$T_1$ is inserted into the first recess 21$T_1$ in the fixed part 21. The second projecting part 31$T_2$ located opposite the first projecting part 31$T_1$ protrudes from the end surface on the long side of the outer edge of the rear surface 31$S_5$ and sandwiches the insertion hole 32. The second projecting part 31$T_2$ is inserted into the second recess 21$T_2$ of the fixed part 21. The second projecting part 31$T_2$ is substantially the same shape as the first projecting part 31$T_1$ and is similarly located at the center of the end surface on the long side.

Here, as illustrated in FIG. 4, the first projecting part 31$T_1$ is tapered toward the tip. Therefore, when the first projecting part 31$T_1$ is cut along the third direction the cross-sectional shape of the first projecting part 31$T_1$ is one that tapers toward the tip. The outer peripheral surface Q1 of the first projecting part 31$T_1$ is spaced apart from the inner bottom surface R1 of the first recess 21$T_1$. The gap between the inner bottom surface R1 and the outer peripheral surface Q1 increases toward the tip end of the first projecting part 31$T_1$. That is, the gap between the inner bottom surface R1 and the outer peripheral surface Q1 at the tip end of the first projecting part 31$T_1$ is greater than the gap at the base end. Additionally, the outer peripheral surface Q1 is also spaced apart from the inner side surface R2 of the first recess $21T_1$. The second projection part $31T_2$ is similarly tapered toward the tip end. The outer peripheral surface Q2 of the second projecting part $31T_2$ is spaced apart from the inner bottom surface R3 of the second recess $21T_2$. The gap between the inner bottom surface R3 and the outer peripheral surface Q2 increases toward the tip end of the second projection part $31T_2$. That is, the gap between the inner bottom surface R3 and the outer peripheral surface Q2 at the tip end of the second projecting part $31T_2$ is greater than the gap at the base end. Finally, the outer peripheral surface Q2 is also spaced apart from the inner side surface R4 of the second recess $21T_2$.

The shallowest portion of first support 101 and the second support 102 from the base end surface of the tooth body 31 forms the deepest part of the insertion hole 32. The sign pocket 33 is formed between the first support 101 and the second support 102. Lengthwise of the tooth body 31, the sign pocket 33 is narrower than the bottom of the insertion hole 32 at the hole part formed at the bottom of the insertion hole 32.

The first support 101 includes a first supporting surface 101S. The first supporting surface 101S forms a portion of the bottom surface of the insertion hole 32. The first supporting surface 101S faces the tip end surface $22S_5$ of the inserted part 22. A small gap may be provided between the first supporting surface 101S and the tip end surface $22S_5$.

The second support 102 includes a second supporting surface 102S. The second supporting surface 102S forms a portion of the bottom surface of the insertion hole 32. The second supporting surface 102S faces the tip end surface $22S_5$ of the inserted part 22. A small gap may be provided between the second supporting surface 102S and the tip end surface $22S_5$.

Figure 7:
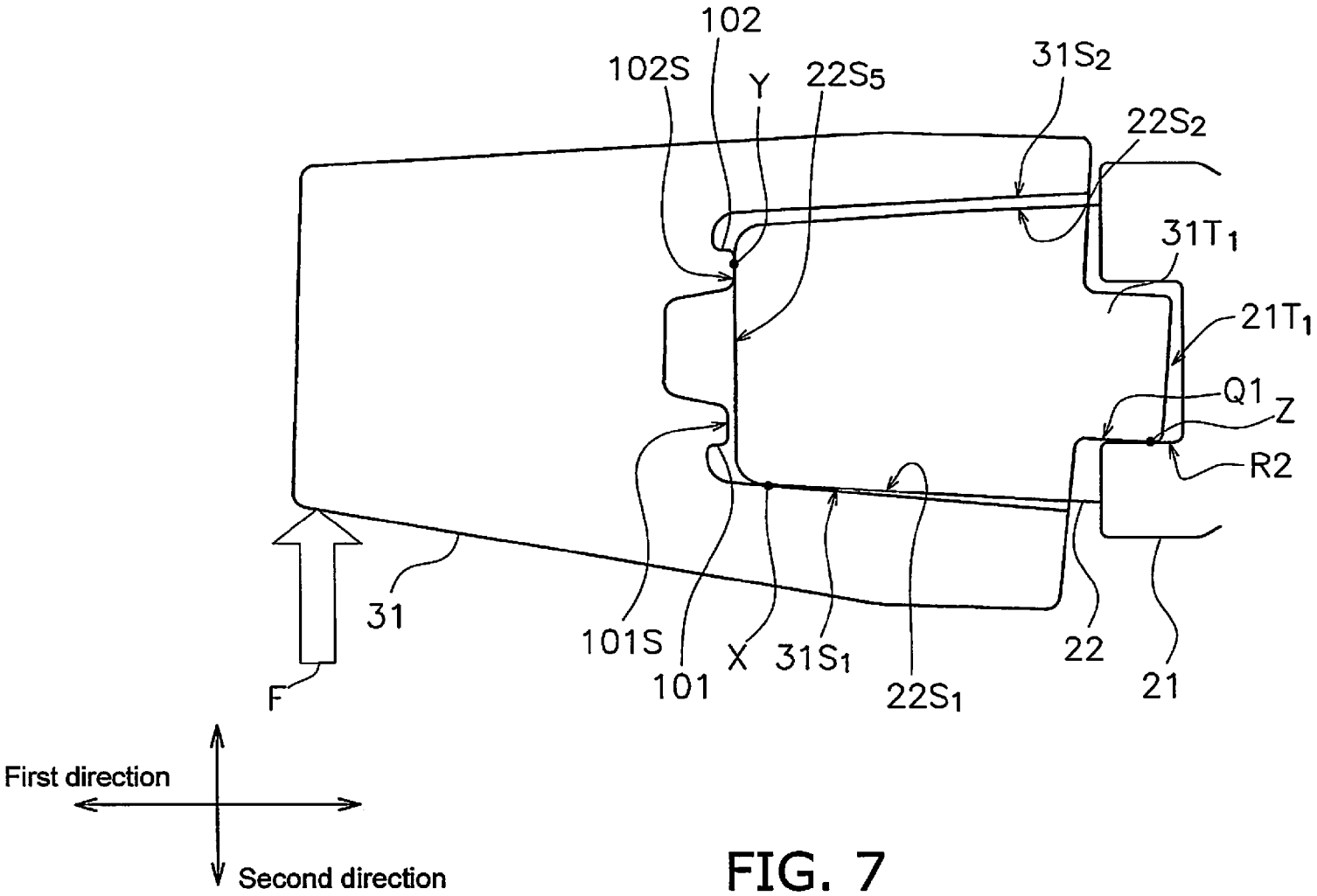
FIG. 7 is a transparent top view of the digging tooth mounting assembly.

FIG. 7 is a transparent top view of the digging tooth mounting assembly 15. FIG. 7 illustrates a tooth 30 and an adaptor 20 used for a number of hours corresponding to use in excavation work. Additionally, in FIG. 7 external forces F act on the tooth 30, and the tooth 30 pivots in the second direction relative to the adapter 20.

As illustrated in FIG. 7, the inner side surface $31S_1$ of the tooth body 31 and the first side surface $22S_1$ of the inserted part 22 make contact at a point X. Further the second supporting surface 102S of the tooth body 31 and the tip end surface $22S_5$ of the inserted part 22 make contact at a point Y. Furthermore, the outer peripheral surface Q1 of the first projecting part $31T_1$ and the inner side surface of the first recess $21T_1$ make contact at a point Z. In contrast, the second inner side surface $31S_2$ of the tooth body 31 and the second side surface $22S_2$ of the inserted part 22 are spaced from each other.

In this manner, the tooth 30, which is inclined relative to the inserted part 22, is supported by the adapter 20 at the three points. In particular, the contact between the outer peripheral surface Q1 and the inner side surface R2 separates the second inner side surface $31S_2$ and the second side surface $22S_2$. At the point Z where the outer peripheral surface Q1 and the inner side surface R2 are in contact is further away from the point X in the first direction than a virtual point where the second inner side surface $31S_2$ is in contact with the second side surface $22S_2$. Accordingly, the amount of stress applied between the tooth 30 and the adapter 20 may be reduced compared to a case where the second inner side surface $31S_2$ is in contact with the second side surface $22S_2$.

Although not illustrated, when the tooth 30 is inclined toward the direction opposite the direction shown in FIG. 7, the second inner side surface of the tooth body 31 and the second side surface $22S_2$ of the inserted part 22, the first supporting surface 101S of the tooth body 31 and the tip end surface $22S_5$ of the inserted part 22, and the outer peripheral surface Q1 of the first projecting part $31T_1$ and the inner side surface R2 of the first recess part $21T_1$, are in contact. In this case, the first inner side surface $31S_1$ of the tooth body 31 and the first side surface $22S_1$ of the inserted part 22 are spaced apart from each other. Even in this case, similar to above, the amount of stress applied between the tooth 30 and the adapter 20 may be reduced.

As illustrated in FIG. 6, the insertion hole 32 is formed in the rear surface $31S_5$ of the tooth body 31. The insertion hole 32 receives the inserted part 22 of the adapter 20. The insertion hole 32 is tapered to correspond to the external shape of the adapter 20. The bottom surface of the insertion hole 32 includes the first supporting surface 101S and the second supporting surface 102S. The side surfaces of the insertion hole 32 include the first inner side surface $31S_1$, the second inner side surface $31S_2$, the upper inner surface $31S_3$, and the lower inner surface $31S_4$.

The sign pocket 33 (hole part) forms the bottom surface of the insertion hole 32, as illustrated in FIG. 6. That is, the sign pocket 33 is formed to extend from the rear of the insertion hole 32. The sign pocket 33 is formed between the first support 101 and the second support 102 of the tooth body 31. The sign pocket 33 is the gap between the first support 101 and the second support 102.

Figure 8:
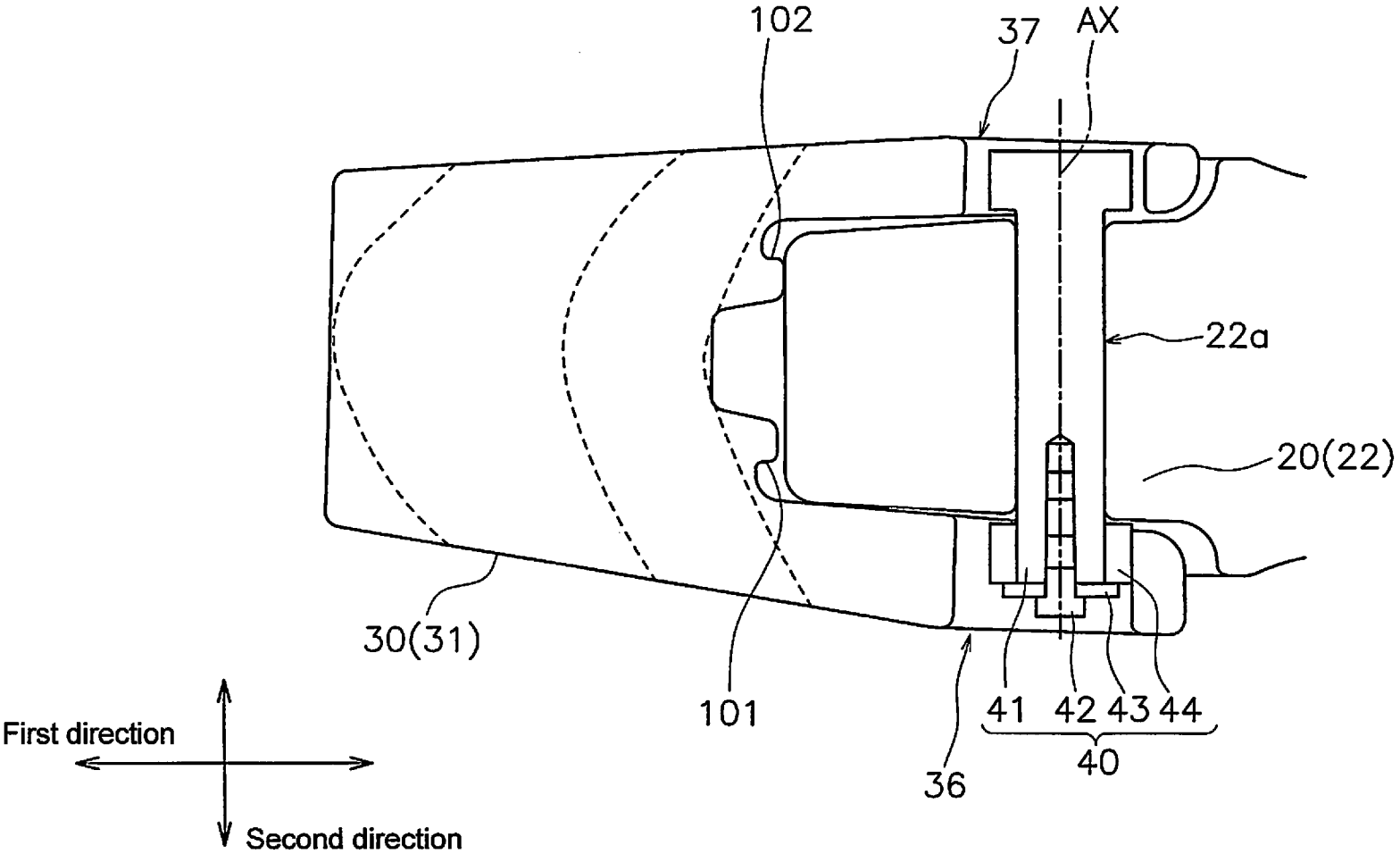
FIG. 8 is a cross-sectional view of A-A in FIG. 4 in which the digging tooth is pivoted relative to an adapter.

The function of the sign pocket 33 will be described with reference to FIG. 8. FIG. 8 is a cross-sectional view of A-A in FIG. 4. FIG. 8 illustrates a tooth 30 and an adapter 20 used for a number of hours corresponding to hours of excavation work, where the tooth 30 is pivoting relative to the adaptor 20 in the second direction.

First, the sign pocket 33 functions as a store for dirt and the like entering from between the adapter 20 and the tooth 30. Hereby, the sign pocket 33 prevents dirt entering from between the adapter 20 and the tooth 30, and more specifically, prevents dirt entering from between the first support 101 and the second support 102 from getting sandwiched there. When dirt gets sandwiched between the first support 101 and the second support 102, wear progresses on both supports and the surrounding surfaces, leading to a large amount of rattling of the tooth 30. Wear increases when the amount of rattling increases and therefore shortens the operating lifespan of the tooth 30 and the adapter 20. The sign pocket 33 prevents the entry of dirt as above described, and therefore suppresses the wear of the tooth 30 and the inserted part 22 of the adapter 20.

The dotted lines in FIG. 8 virtually illustrate the wear lines on the tooth 30 as the tooth 30 wears. As illustrated in FIG. 8, the tip end of the tooth 30 wears at the same rate across the board after the loss of the tip ends on both sides in the initial stage due to wear. Moreover, as the wear progresses, the sign pocket 33 is exposed to the tip end of the tooth 30. The operator may then verify that the sign pocket 33 is exposed at the tip end of the tooth, namely that the hole at the tip end of the tooth 30 is open, to identify that the operating life of the tooth is approaching an end. It is preferable that the sign pocket be designed so that in a normal usage environment the sign pocket 33 is exposed prior to exposure of the first extension hole 34 and the second extension hole 35. The positional relationship between the sign pocket 33, the first extension hole 34, and the second extension hole 35 will be described later.

Figure 9:
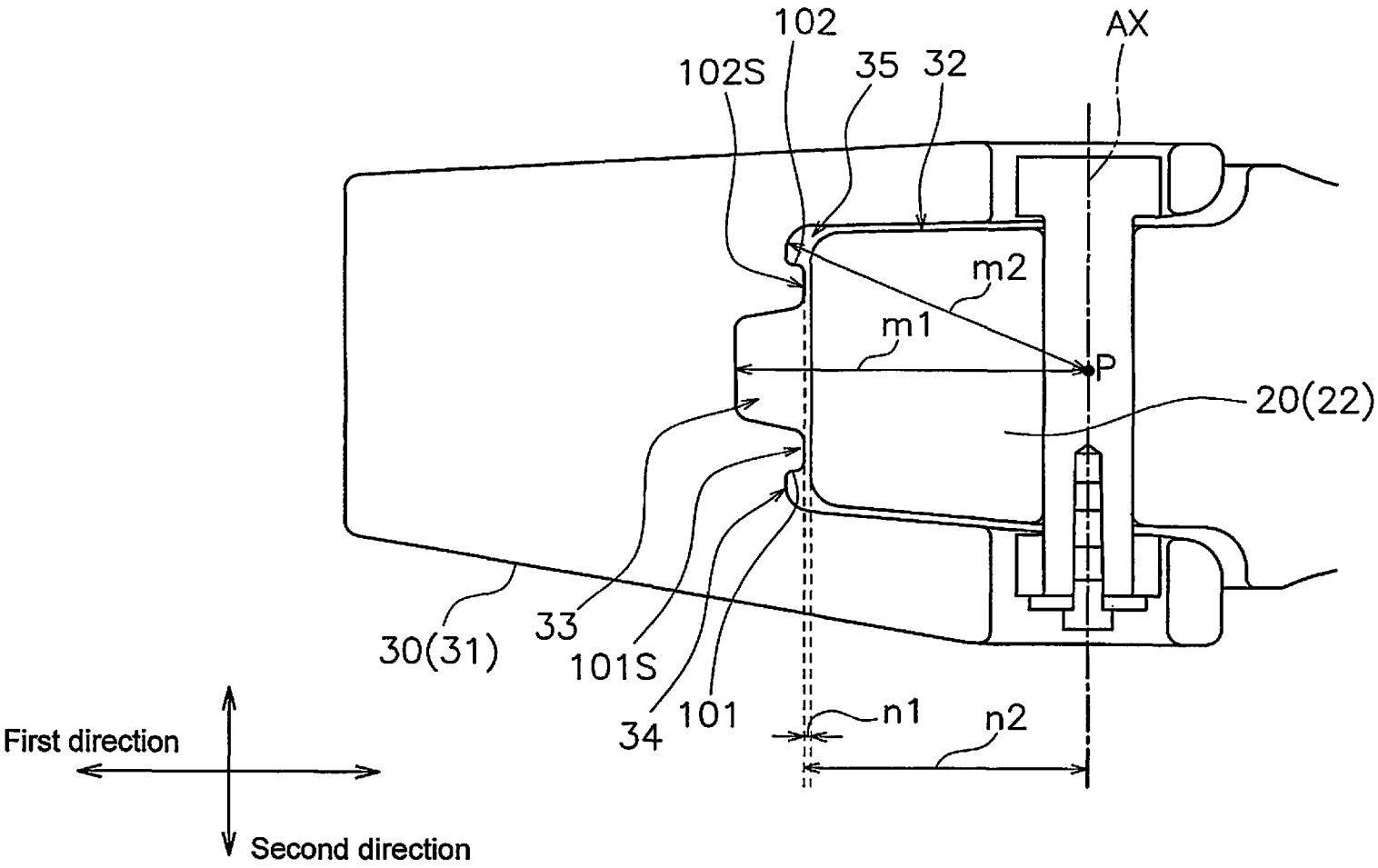
FIG. 9 is a cross-sectional view of A-A in FIG. 4 in which the digging tooth is not pivoted relative to the adapter.

The first extension hole 34 and the second extension hole 35 form a portion of the insertion hole 32 (refer to FIG. 9).

The first extension hole 34 and the second extension hole 35 are formed on each side of the first support 101 and the second support 102 in the second direction. More specifically, the first extension hole 34 is on the opposite side of the sign pocket 33 sandwiching the first support 101 therebetween. The second extension hole 35 is on the opposite side of the sign pocket 33 sandwiching the second support 102 therebetween. The first extension hole 34 and the second extension hole 35 are each shallower and narrower than the sign pocket 33. The first extension hole 34 and the second extension hole 35 configured in this manner are provided so that the corners of the adapter 20 (namely, both end sections at the tip end of the adapter 20 in the second direction) do not contact the inner wall of the insertion hole 32. More specifically, it is preferable that the corners of the adapter 20 do not contact the inner wall of the tooth 30 even when the tooth 30 is inclined relative to the adapter 20 (refer to FIG. 8).

A first shaft bore 36 and a second shaft bore 37 (one example of a pair of shaft bores) each pass through the tooth body 31 as illustrated in FIG. 8. The first shaft bore 36 and the second shaft bore 37 respectively connect to the insertion hole 32. The first shaft bore 36 and the second shaft bore 37 are formed on a straight line along the second direction. That is, the first shaft bore 36 and the second shaft bore 37 are formed along the long side making up the outer edge of the rear surface $31S_5$. Therefore, the first shaft bore 36 and the second shaft bore 37 are spaced apart from the first projecting part $31T_1$, and the second projection part $31T_2$. In FIG. 8 the center line AX of the first shaft bore 36 and the second shaft bore 37 is represented by a dot-dash line. As illustrated in FIG. 8, the first shaft bore 36 and the second shaft bore 37 house both end parts of the retainer assembly 40.

The retainer assembly 40 includes a pin 41, a bolt 42, a washer 43, and a bushing 44, as illustrated in FIG. 5. As illustrated in FIG. 8, the pin 41 is inserted through the insertion through hole 22*a* in the inserted part 22. In the present embodiment, the central shaft of the pin 41 substantially coincides with the center line AX of the first shaft bore 36 and the second shaft bore 37. The bolt 42 is secured at one end of the pin 41 via the washer 43 and the bushing 44. The washer 43 and the bushing 44 are stored inside the first shaft bore 36. When the tooth 30 is inserted into the adapter 20, the pin 41 is inserted through the insertion through hole 22*a* in the adapter 20 such that putting together the retainer assembly holds the tooth 30 onto the adapter 20. While the retainer assembly 40 has the above described configuration in the present exemplary embodiment, the retainer assembly of the present invention is not limited to this configuration, and various generally known retainer assembly configurations may be adopted.

Positional Relationship of the Adapter 20 and the Tooth 30

Next, the positional relationship between the adapter 20 and the tooth 30 is described with reference to the drawings. FIG. 9 is a cross-sectional view of A-A in FIG. 4. However, FIG. 9 differs from FIG. 8 in that FIG. 9 illustrates when there is no pivoting of the tooth 30 relative to the adapter 20 in the second direction.

In FIG. 9, the center position on the center line AX for the first support 101 and the second support 102 is represented by a reference point P. That is, the reference point P is at the center of the tooth body 31 in the second direction on the center line AX.

As illustrated in FIG. 9, a gap m1 between the reference point P and the deepest part of the sign pocket 33 is larger than a gap m2 between the reference point P and the deepest part of the second extension hole 35. Although not illustrated, the gap between the reference point P and the first extension hole 34 is approximately the same as the gap m2 between the reference point P and the deepest part of the second extension hole 35. The deepest part of the first extension hole 34 or the second extension hole 35 is an example of the deepest part of the insertion hole 32. The gap m1 is preferably no less than 1.05 times the size of the gap m2, and is more preferably no less than 1.10 times the size of the gap m2.

As illustrated in FIG. 9, preferably a fine gap n1 between the tip end of the insertion hole 22, and the first support 101 and the second support 102 is no more than 5% of a gap n2 between the center line AX, and the first support 101 and the second support 102, and more preferably the fine gap n1 is no more than 2% of the gap n2.

Operation and Effects

The adapter 20 includes a first recess $21T_1$ formed in the front surface $21S_1$, and the tooth 30 includes a first projecting part $31T_1$ formed on the rear surface $31S_5$. The projecting part $31T_1$ is inserted into the first recess $21T_1$.

Accordingly, as illustrated in FIG. 7, when there are external forces F acting on the tooth 30, the outer peripheral surface Q1 of the first projecting part $31T_1$ and the inner side surface R2 of the first recess $21T_1$ are in contact at point Z. Therefore, the amount of stress applied between the tooth 30 and the adapter 20 may be reduced compared to a case where the second inner side surface $31S_2$ is in contact with the second side surface $22S_2$. As a result, suppressing the wear of the adapter 20 and the tooth 30 thereby controls the pivoting of the tooth 30 in relation to the adapter 20.

The outer peripheral surface Q1 of the first projecting part $31T_1$ is spaced apart from the inner bottom surface R1 of the first recess $21T_1$. Accordingly there is a gap between the outer peripheral surface Q1, and the inner bottom surface R1 and the inner side surface R2. Therefore, the outer peripheral surface Q1, and the inner bottom surface R1 and the inner side surface R2 are prevented from coming into contact when no external forces F are acting on the tooth 30. As a result, the first projecting part $31T_1$ is prevented from breaking when the adapter 30 and the tooth 30 have been used little for excavation and there is little rattling of the tooth 30 in relation to the adapter 20.

Other Exemplary Embodiments

The present invention is not limited to the exemplary embodiment such as above described, and may be modified or revised in various ways without deviating from the scope of the invention.

For instance, the bucket 100 was given as one example of an excavating tool in the above-mentioned exemplary embodiment; however, the present invention is not limited to this configuration. The excavating tool may be, for instance, a ripper that can be mounted to a bulldozer.

Figure 10:
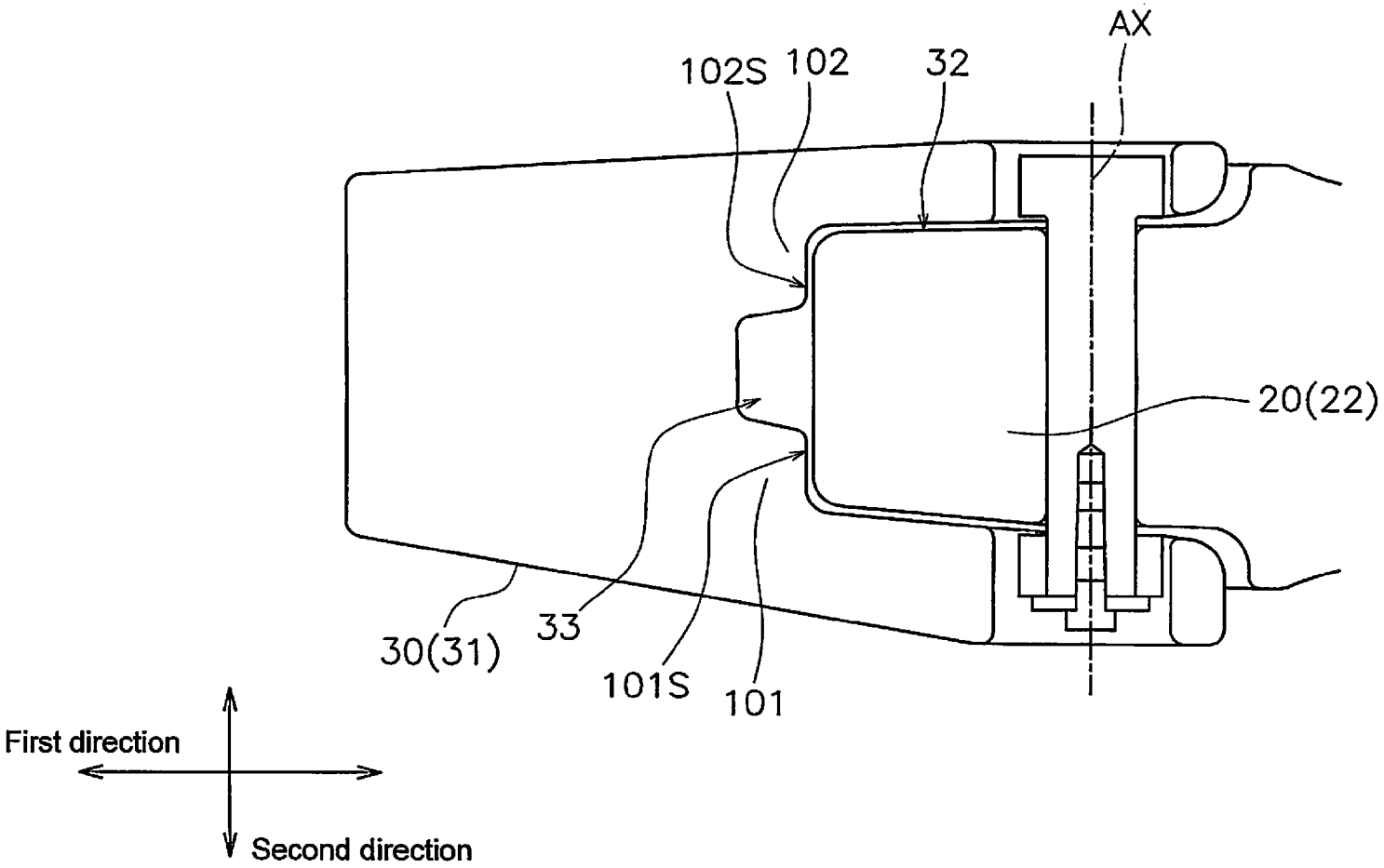
FIG. 10 is a cross-sectional view illustrating a configuration of the digging tooth.

Further in the above exemplary embodiment, the insertion hole 32 in the tooth 30 includes a first extension hole 34 and a second extension hole 35; however the present invention is not limited to this configuration. As illustrated in FIG. 10, the insertion hole 32 need not include the first extension hole 34 and the second extension hole 35. In this case, the corner at the first support 101 and the first inner side surface $31S_1$, and the corner at the second support 102 and the second inner side surface $31S_2$ are the deepest portions of the insertion hole 32.

Finally in the above exemplary embodiment the tooth body 31 includes a first projecting part $31T_1$ and a second projecting part $31T_2$ on the end surface of the long side of the rear surface $31S_5$, however the present invention is not limited to this configuration. The tooth body 31 need not include the first projecting part 31$T_1$ and the second projecting part 31$T_2$, and may include only one of the first projecting part 31$T_1$ or the second projecting part 31$T_2$. Alternatively, in addition to the projecting part on the long sides, another projecting part may be further provided on the end surface on the short side.

The present invention provides a digging tooth mounting assembly and digging tooth whereby it is possible to control pivoting and suppress wear and therefore may be employed in a field involving work machines.

The invention claimed is:

1. A digging tooth mounting assembly comprising:

an adapter;

a digging tooth mounted to the adapter; and a retainer assembly holding the digging tooth onto the adapter;

the adapter including a front surface facing the digging tooth, a recess formed on the front surface, an inserted part projecting from the front surface, and a insertion through hole formed in the inserted part for receiving the retainer assembly, the inserted part of the adapter having a first side surface and a second side surface;

the digging tooth including a rear surface facing the front surface of the adapter, a projecting part formed on the rear surface for insertion into the recess, an insertion hole formed on the rear surface for receiving the inserted part, and a pair of shaft bores for receiving the retainer assembly, the digging tooth including a first inner side surface and a second inner side surface that are disposed inside the digging tooth and arranged to face the first side surface and the second side surface of the adapter, respectively;

the rear surface having a rectangular outer edge constituted by a pair of long sides and a pair of short sides;

the recess having an inner bottom surface and an inner side surface, the inner side surface partially surrounding a perimeter of the inner bottom surface, the inner side surface being open on one side to allow insertion of the projecting part of the digging tooth, the pair of shaft bores being formed to extend through the digging tooth in a direction parallel to a direction in which the pair of long sides extend; and an outer peripheral surface of the projecting part facing the inner bottom surface and the inner side surface of the recess, the outer peripheral surface of the projecting part being dimensioned such that the projecting part can be arranged inside the recess without contacting the inner side surface of the recess while the digging tooth is mounted to the adapter with the retainer assembly installed, the adapter and the digging tooth being configured such that when a force acts on the digging tooth such that the digging tooth pivots with respect to the adapter and the first inner side surface contacts the first side surface of the adapter, the second inner side surface of the digging tooth does not contact the second side surface of the adapter.

2. The digging tooth mounting assembly according to claim 1, wherein the closer to a tip end part of the projecting part the larger a gap between the inner bottom surface of the recess and the outer peripheral surface of the projecting part.

3. The digging tooth mounting assembly according to claim 1, wherein the projecting part is formed on the long side of the rear surface.

4. The digging tooth mounting assembly according to claim 1, wherein the projecting part is spaced apart from the pair of shaft bores.

5. The digging tooth mounting assembly according to claim 2, wherein the projecting part is formed on the long side of the rear surface.

6. The digging tooth mounting assembly according to claim 2, wherein the projecting part is spaced apart from the pair of shaft bores.

7. The digging tooth mounting assembly according to claim 3, wherein the projecting part is spaced apart from the pair of shaft bores.

8. The digging tooth mounting assembly according to claim 1, wherein the digging tooth further includes a first support and a second support formed inside the digging tooth on a bottom surface of the insertion hole, the first support and the second support protruding from the bottom surface toward a tip end surface of the inserted part of the adapter, the first support being disposed closer to the first inner side surface than to the second inner side surface, the second support being disposed closer to the second inner side surface than to the first inner side surface, the adapter and the digging tooth are configured such that when the force acts on the digging tooth such that the digging tooth pivots with respect to the adapter and the first inner side surface contacts the first side surface of the adapter, the projecting part of the digging tooth contacts the inner side surface of the recess and the second support of the digging tooth contacts a tip end surface of the adapter.

9. The digging tooth mounting assembly according to claim 1, wherein a portion of each of the first side surface and the second side surface of the adapter is exposed through a gap between the rear surface of the digging tooth and the front surface of the adapter.

* * * * *